United States Patent [19]

Youngers

[11] 4,327,508

[45] May 4, 1982

[54] TRENCHER DIGGING CHAIN SPROCKET DRIVE

[75] Inventor: Stephen A. Youngers, Clearwater, Kans.

[73] Assignee: J. I. Case Company, Racine, Wis.

[21] Appl. No.: 213,805

[22] Filed: Dec. 8, 1980

[51] Int. Cl.[3] ..... E02F 5/06

[52] U.S. Cl. ..... 37/86; 37/191 A; 172/119; 172/125; 299/36

[58] Field of Search ..... 37/86, 87, 88, 89, 90, 37/83, 80, 191 A, 191 R, 192 R, 192 A; 299/36; 172/119, 125

[56] References Cited

U.S. PATENT DOCUMENTS

| | | | |
|---|---|---|---|
| 1,143,897 | 6/1915 | Flexner et al. | 37/192 R X |
| 3,044,194 | 7/1962 | Balkheimer | 37/191 A X |
| 3,057,088 | 10/1962 | George et al. | 37/86 A |
| 3,668,794 | 6/1972 | Marquardt et al. | 37/89 X |

FOREIGN PATENT DOCUMENTS

| | | | |
|---|---|---|---|
| 694594 | 8/1940 | Fed. Rep. of Germany | 37/192 |
| 1077550 | 8/1967 | United Kingdom | 37/191 A |

*Primary Examiner*—Edgar S. Burr
*Assistant Examiner*—Moshe I. Cohen
*Attorney, Agent, or Firm*—Cullen, Sloman, Cantor, Grauer, Scott & Rutherford

[57] ABSTRACT

A drive train assembly is provided for the digging chain drive sprocket and spoil dispersing auger of a hydrostatically operated trenching machine. The drive assembly is totally enclosed and includes a hydraulic motor, a rotatable drive sprocket-hub subassembly, a planetary gearbox, and a boom lift casting. The planetary gearbox and hydraulic motor are mounted on opposite ends of the boom lift casting, and they are drivingly interconnected by a drive shaft that passes through the casting. The planetary gearbox includes a housing for rotatably mounting the spoil dispersing auger such that the gearbox housing and auger act as a heat sink to dissipate heat generated by the driven gears within the gearbox. The digging chain drive sprocket subassembly is rotatably mounted on the boom lift casting adjacent the planetary gearbox, and it is connected to the gearbox whereby the digging chain drive sprocket and auger are driven in unison by the hydraulic motor.

1 Claim, 3 Drawing Figures

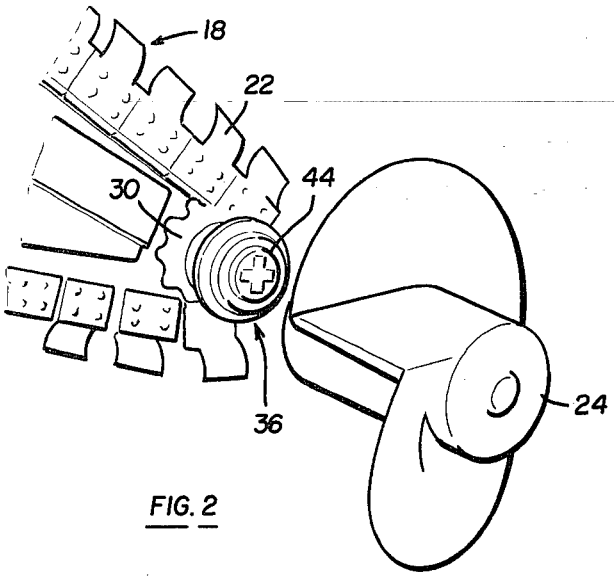
FIG. 2
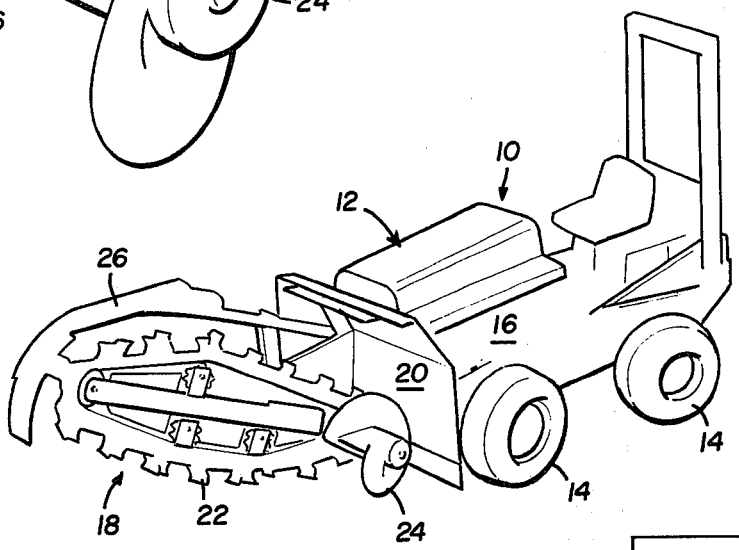
FIG. 1
FIG. 3
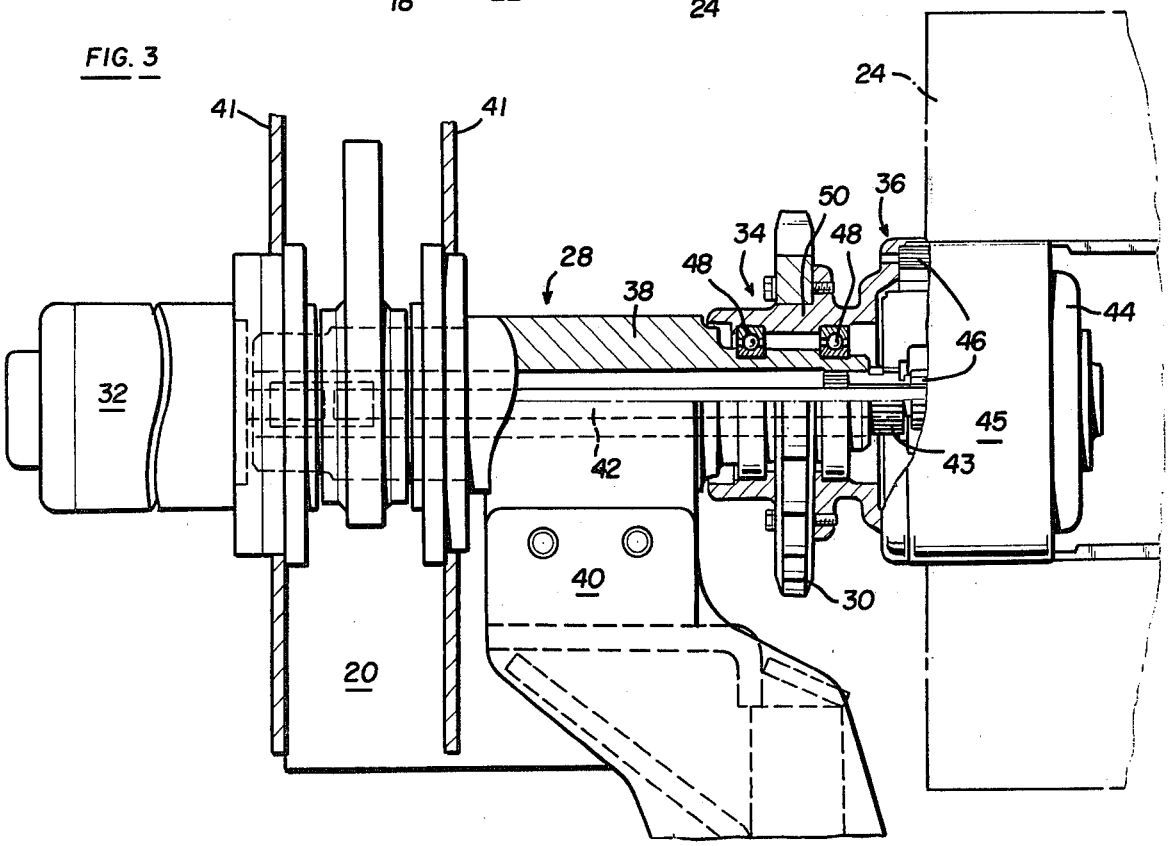

TRENCHER DIGGING CHAIN SPROCKET DRIVE

BACKGROUND OF THE INVENTION

The present invention relates to a drive train assembly for a hydrostatically operated trenching machine, and more particularly to a totally enclosed drive train for the digging chain drive sprocket and spoil dispersing auger.

It is conventional to provide a hydrostatically operated trenching machine having a digging boom which is connected to a tractor for pivotal movement. A digging chain is rotatably mounted on the boom and driven for digging in the ground, and an auger is provided which disperses the spoil that is dug during the trenching operation to the sides of the trench.

A problem with known trenching machines relates to the complexity of the drive trains for the digging chain and spoil dispersing auger. Typically, the drive assemblies for the chain and auger are separate and include a plurality of sprockets, belts, chains, drive shafts, and the like. These drive assemblies are complex and in some instances uncovered which permits dirt and debris to enter between the moving parts thereby causing jamming or breakage.

Thus, there has been a need for an improved drive train assembly for the digging chain and spoil dispersing auger of trenching machines which is compact and fully covered to prevent the entry of debris and the like into the moving parts. The disadvantages of conventional drive assemblies for digging chains and spoil dispersing augers have resulted in the improved drive train assembly of the present invention which is totally enclosed and provides the rotational driving force for both the digging chain and auger.

SUMMARY OF THE INVENTION

The present invention for hydrostatically operated trenching machines includes a totally enclosed drive train assembly for the digging chain drive sprocket and spoil dispersing auger. The drive train assembly generally includes a hydraulic drive motor, a rotatable drive sprocket-hub subassembly, a planetary gearbox, and a boom lift casting. The hydraulic drive motor is drivingly connected to the planetary gearbox by means of a drive shaft that passes through the boom lift casting.

The planetary gearbox is mounted on one end of the boom lift casting and includes a rotatably driven housing for mounting the spoil dispersing auger. The auger receives the rotational driving force transmitted by the hydraulic motor to the housing through the gearbox. Further, the gearbox housing and connected auger act as a heat sink for dissipating the heat generated by the driven gears within the gear box.

The digging chain drive sprocket subassembly is rotatably mounted on the trencher boom lift casting adjacent the planetary gearbox, and it is connected to the driven gearbox housing to receive the rotational driving force transmitted to the gearbox by the hydraulic motor. The digging chain drive sprocket and auger are driven in unison by the hydraulic motor which is mounted to the end of the boom lift casting opposite the planetary gearbox.

Thus, the drive assembly for the digging chain drive sprocket and spoil dispersing auger is entirely enclosed to prevent debris and the like from jamming or breaking the moving parts. Further, a single drive assembly powers both the digging chain drive sprocket and auger thereby eliminating conventional arrangements including plural sprockets, chains, drive shafts and the like.

Other advantages and meritorious features of the totally enclosed drive train assembly of the present invention will be more fully understood from the following description of the preferred embodiment, the appended claims, and the drawings, a brief description of which follows.

BRIEF DESCRIPTION OF DRAWINGS

FIG. 1 is a perspective view of a trenching machine embodying the totally enclosed drive train assembly of the present invention.

FIG. 2 is a partial perspective view illustrating the assembly of the spoil dispersing auger to the planetary gearbox.

FIG. 3 is a rear view of the enclosed drive train assembly with a portion cut away for easier viewing.

DETAILED DESCRIPTION OF THE INVENTION

A preferred embodiment of a hydrostatically operated trenching machine including the totally enclosed drive train assembly made in accordance with the teachings of the present invention is illustrated in FIGS. 1–3.

The hydrostatically operated trenching machine 10 shown in FIG. 1 is seen to include a tractor 12 with ground engaging wheels 14 and an engine 16. A trenching or digging boom 18 is pivotally mounted to the tractor main frame 20 and a digging chain 22 is rotatably mounted to the trenching boom for digging in the ground.

An auger 24 is provided which disperses the spoil that is dug during the trenching operation to the sides of the trench. A crumber 26 is attached to the trenching boom 18 for cleaning the bottom of the trench during the digging operation.

The present invention relates to a drive train assembly, generally 28, which is a totally enclosed drive assembly for the digging chain drive sprocket 30 and spoil dispersing auger 24. The drive train assembly 28 generally includes a hydraulic motor 32, a rotatable drive sprocket-hub subassembly 34, a planetary gearbox 36, and a boom lift casting 38.

The generally cylindrical boom lift casting 38 is mounted to the tractor frame 20 by frame members 40 and 41 for pivotally supporting the trenching boom 18. The hydraulic drive motor 32 is mounted to one end of the boom lift casting 38 while the planetary gearbox 36 is mounted to its opposite end. The planetary gearbox 36 is drivingly connected to the hydraulic drive motor 32 by means of a drive shaft 42 that passes through the boom lift casting 38 and a spline connection 43.

The planetary gearbox 36 includes an outer peripheral housing 44 for rotatably mounting the spoil dispersing auger 24 at its hub 45. The rotational driving force of hydraulic motor 32 is transmitted to auger 24 through gears 46 which rotatably drive housing 44. Further, the gearbox housing 44 and connected auger 24 act as a heat sink for dissipating the heat generated by the drive gears 46 within the gearbox 36. Housing 44 also permits the auger to be connected or removed quickly and conveniently as illustrated in FIG. 2.

The digging chain drive sprocket subassembly 34 is rotatably mounted by bearings 48 on boom lift casting 38 adjacent planetary gearbox 36. Gearbox housing 44 and sprocket 30 are interconnected by sprocket assembly hub 50. The rotational driving force received by gearbox 36 from hydraulic motor 32 is transmitted through gearbox housing 44 to sprocket 30 by way of hub 50. Thus, the digging chain drive sprocket 30 and spoil dispersing auger 24 are driven in unison in a compact and simple manner.

The drive assembly 28 for the digging chain drive sprocket 30 and spoil dispersing auger 24 is entirely enclosed to prevent debris and the like from jamming or breaking the moving parts. A single drive assembly powers both sprocket 30 and auger 24 in unison thereby eliminating conventional arrangements including plural sprockets, chains, drive shafts and the like. Further, the planetary gearbox housing provides both a heat sink and convenient mount for the auger such that it can be installed or removed quickly and conveniently.

It will be apparent to those skilled in the art that the foregoing disclosure is exemplary in nature rather than limiting, the invention being limited only by the appended claims.

I claim:

1. In a hydrostatically operated trenching machine including a digging boom which is connected to the frame of a tractor for pivotal movement, a digging chain rotatably mounted on said boom and said digging chain being driven by a drive sprocket, and an auger for dispersing the spoil that is dug during the trenching operation to the sides of a trench, the improvement comprising:

a totally enclosed drive train assembly for rotatably driving the digging chain drive sprocket and spoil dispersing auger, said drive train assembly including a generally cylindrical boom lift casting mounted to said tractor frame, a hydraulic motor mounted to one end of said boom lift casting and a planetary gearbox mounted to the opposite end of said casting, said motor being drivingly connected to gears in said gearbox by a drive shaft which passes through said boom lift casting;

said planetary gearbox including a housing for rotatably mounting said auger, said housing being rotatably driven by said hydraulic motor through said gears in said gearbox, and said housing and connected auger acting as a heat sink for dissipating heat generated by the driven gears within said gearbox; and said digging chain drive sprocket being rotatably mounted on said boom lift casting adjacent said gearbox, said drive sprocket and gearbox housing being mounted to and interconnected by a hub member such that the rotational driving force received by said gearbox housing from said motor is transmitted to said drive sprocket through said hub member whereby the digging chain drive sprocket and spoil dispersing auger are driven in unison.

* * * * *